US010341767B2

(12) United States Patent
Lawrence et al.

(10) Patent No.: US 10,341,767 B2
(45) Date of Patent: Jul. 2, 2019

(54) SPEAKER PROTECTION EXCURSION OVERSIGHT

(71) Applicant: Cirrus Logic International Semiconductor Ltd., Edinburgh (GB)

(72) Inventors: Jason Lawrence, Austin, TX (US); Roberto Napoli, Milan (IT); Rong Hu, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/792,189

(22) Filed: Oct. 24, 2017

(65) Prior Publication Data

US 2018/0160227 A1 Jun. 7, 2018

Related U.S. Application Data

(60) Provisional application No. 62/430,750, filed on Dec. 6, 2016.

(51) Int. Cl.
*H04R 3/00* (2006.01)
*H04R 29/00* (2006.01)

(52) U.S. Cl.
CPC ..... *H04R 3/007* (2013.01); *H04R 3/002* (2013.01); *H04R 29/001* (2013.01); *H04R 2201/028* (2013.01); *H04R 2499/11* (2013.01)

(58) Field of Classification Search
CPC ..... H04R 3/007; H04R 29/001; H04R 2201/028; H04R 2499/11; H04R 3/002
See application file for complete search history.

(56) References Cited

U.S. PATENT DOCUMENTS

| | | | |
|---|---|---|---|
| 9,173,027 | B2 | 10/2015 | Su |
| 9,362,878 | B1 | 6/2016 | Su |
| 2012/0179456 | A1 | 7/2012 | Ryu et al. |
| 2012/0288118 | A1 | 11/2012 | Gautama |

(Continued)

FOREIGN PATENT DOCUMENTS

| | | | |
|---|---|---|---|
| EP | 2645740 | A1 | 10/2013 |
| WO | 2015/041765 | A1 | 3/2015 |

OTHER PUBLICATIONS

Andrew Bright, "Active Control of Loudspeakers: An Investigation of Practical Applications", Technical University of Denmark, 2002.

(Continued)

*Primary Examiner* — Sonia L Gay
(74) *Attorney, Agent, or Firm* — Norton Rose Fulbright US LLP

(57) ABSTRACT

Speaker protection may be based on multiple speaker models with oversight logic that controls the speaker protection based on the multiple speaker models. At least one of the speaker models may be based on a speaker excursion determined from feedback information from the speaker, such as a current or voltage measured at the speaker. Excursion based on the speaker feedback may be used to determine an error in an excursion prediction made from the audio signal. The excursion prediction may then be compensated for that error. In some embodiments, a direct displacement estimate of excursion generated from speaker monitor signals is used to correct a fixed excursion model applied to an input audio signal.

18 Claims, 7 Drawing Sheets

(56) References Cited

U.S. PATENT DOCUMENTS

| | | | | |
|---|---|---|---|---|
| 2013/0259245 | A1* | 10/2013 | Cheng | H04R 3/00 381/58 |
| 2014/0254805 | A1 | 9/2014 | Su et al. | |
| 2015/0010168 | A1 | 1/2015 | Cheng et al. | |
| 2015/0124982 | A1 | 5/2015 | Berthelsen et al. | |
| 2015/0181318 | A1* | 6/2015 | Gautama | H04R 1/00 381/59 |
| 2016/0105742 | A1* | 4/2016 | Gautama | H03G 3/20 381/99 |
| 2016/0241960 | A1 | 8/2016 | Cheng et al. | |

OTHER PUBLICATIONS

Wolfgang Klippel, "Nonlinear Adaptive Controller for Loudspeakers with Current Sensor", Audio Engineering Society Convention 106, May 1999.

Richard H. Small, "Direct-Radiator Loudspeaker System Analysis", Journal of the Audio Engineering Society 20(5), pp. 383-395, Jun. 1972.

* cited by examiner

SPEAKER PROTECTION EXCURSION OVERSIGHT

CROSS-REFERENCE TO RELATED PATENT APPLICATIONS

This application claims the benefit of priority of U.S. Provisional Patent Application No. 62/430,750 to Jason Lawrence et al. filed on Dec. 6, 2016 and entitled "Speaker Protection Excursion Oversight," which is hereby incorporated by reference.

FIELD OF THE DISCLOSURE

The instant disclosure relates to audio processing. More specifically, portions of this disclosure relate to speaker protection in mobile devices.

BACKGROUND

Loud, high-fidelity sound is desirable from speakers. This is easily achievable with large speakers. However, mobile devices are shrinking in size, and particularly in thickness. As the mobile device shrinks, the speaker must also shrink to accommodate the mobile form factor. A common speaker for mobile devices is a microspeaker. Regardless of the speaker choice, the reduced size can result in reduced quality of sound from mobile devices. Loud sounds require the cone of the microspeaker to extend further. However, the limited dimensions can cause the cone to contact a solid surface of the mobile device. Even small over-excursions can introduce very unpleasant audio artifacts. If over-excursion occurs for a prolonged time or is large in magnitude, the diaphragm can be mechanically damaged. A conventional solution for reducing such damage is the use of a speaker protection algorithm. The goal of a speaker protection algorithm is to protect the speaker from damage, while maximizing loudness and minimizing loss of audio quality. One conventional speaker protection technique is shown in FIG. 1.

FIG. 1 is a block diagram illustrating a conventional speaker protection system according to the prior art. An audio signal may be input to an adaptive excursion model 110, which generates an excursion prediction. This prediction is provided to an excursion limiter 104, which monitors the prediction for over-excursion events. When an over-excursion event is detected, the volume is rapidly decreased in proportion to the amount of predicted over-excursion. The excursion limiter 104 attenuates a delayed audio stream from delay block 102 to identify over-excursion events before they happen. The attenuated, delayed audio signal is then streamed to an audio amplifier 106, which generates the voltage signal for driving the speaker 112.

The excursion transfer function of the speaker, which is modeled by adaptive excursion model 110, may be subject to sources of variation including part-to-part variation from manufacturing, thermal variation, aging, wear, etc. The adaptive excursion model 110 adapts to these variations to estimate the current excursion transfer function for the speaker. A model adaptation block 108 uses a monitored current and voltage of the speaker to update the adaptive excursion model 110. For the adaptive modeling scheme to work, the model must be sufficiently complex to be able to capture all feasible types of model variation. Conventional solutions to improve the adaptive excursion model are to use higher order models. The drawback is that these higher order models have increased computational complexity that results in higher power usage. Power consumption in a mobile device results in shorter battery life. Also, the danger of over-parameterized models exists which can lead to more error and slower speed of convergence, further increasing power consumption and shortening battery life.

Shortcomings mentioned here are only representative and are included simply to highlight that a need exists for improved electrical components, particularly for audio systems employed in consumer-level devices, such as mobile phones. Embodiments described herein address certain shortcomings but not necessarily each and every one described here or known in the art. Furthermore, embodiments described herein may present other benefits than, and be used in other applications than, those of the shortcomings described above.

SUMMARY

Speaker protection may be based on multiple speaker models with oversight logic that controls the speaker protection based on the multiple speaker models. At least one of the speaker models may be based on a speaker excursion determined from feedback information from the speaker, such as a current or voltage measured at the speaker. Excursion based on the speaker feedback may be used to determine an error in an excursion prediction made from the audio signal. The excursion prediction may then be compensated for that error. In some embodiments, the error correction from this oversight may allow the speaker models to be of low complexity, which reduces the power consumption from speaker protection while still maintaining adequate protection of the speaker. The output of the speaker excursion model determined from speaker feedback information may be used to determine a correction factor for adjusting the non-adaptive (e.g., fixed) excursion model used by the excursion limiter.

In one embodiment, a first speaker protection algorithm is applied to an input audio signal to generate an excursion estimate. That excursion estimate is applied to an excursion limiter, which modifies the input audio signal, such as by attenuating loud sounds, for output to a microspeaker. Excursion oversight logic may generate a second excursion model based on feedback from the microspeaker, such as based on a current and/or voltage measured from the speaker. From the second excursion model, the oversight logic may determine an error signal that may improve the first speaker protection algorithm and reduce a likelihood of over-excursion of the micro speaker.

A method for overseeing excursion characterization for a speaker model of a speaker may include using a first speaker model to determine an excursion estimate for the speaker. Based on an audio input signal and the speaker to which the speaker model is modeled, another excursion estimate may be determined. The excursion estimate is compared to the other excursion estimate. Upon detecting an error based on the comparison of the excursion estimate and the other excursion estimate, a correction factor is determined that is used to provide a corrected excursion estimate for the speaker. That correction factor may be a ratio of the two estimates. The corrected excursion estimate is used to estimate an excursion characteristic of the speaker, instead of the excursion estimate of the speaker itself that is based on the speaker model, while characteristics of the speaker model are still generally and statically maintained.

In some embodiments, a non-adaptive excursion model may be used in speaker protection as one of the two or more speaker models to reduce power consumption and/or system complexity. In these embodiments, the oversight scheme does not adapt the speaker model, as is common in other speaker protection algorithms, and has several advantages over these techniques. The oversight mechanism can detect and react to excursion modeling errors in a very general way because the embodiments do not solely rely on adapting a model. Furthermore, oversight techniques assume no a priori knowledge of the dynamics of the modeling error. Rather, the oversight techniques may use a modeling error detectable through the backEMF (BEMF) of the speaker, which can be determined from speaker feedback. The oversight techniques are relatively simple, have low computational cost, are numerically robust, do not have convergence problems, and are unlikely to become unstable.

Embodiments of speaker protection systems with excursion oversight are also robust to different stimulus. The oversight can work equally well with broadband, narrowband, or tonal stimulus, in contrast to adaptive techniques which generally require broadband stimulus. Robustness of such a technique may be provided because a model is not trying to be identified, but instead modeling errors are being searched for, found, and a correction factor determined based on the modeling errors.

Electronic devices incorporating the audio processing described above may benefit from improved sound quality and/or improved dynamic range. Integrated circuits of the electronic devices may include an audio controller with the described functionality. The IC may also include an analog-to-digital converter (ADC). The ADC may be used to convert an analog signal, such as a PWM-encoded audio signal, to a digital representation of the analog signal. The IC may alternatively or additionally include a digital-to-analog converter (DAC). Audio controllers may be used in electronic devices with audio outputs, such as music players, CD players, DVD players, Blu-ray players, headphones, portable speakers, headsets, mobile phones, tablet computers, personal computers, set-top boxes, digital video recorder (DVR) boxes, home theatre receivers, infotainment systems, automobile audio systems, and the like.

According to one embodiment, a method may include modifying an input audio signal by an excursion limiter based on a first excursion prediction to obtain an excursion-limited audio signal for reproduction at a transducer; determining a second excursion prediction based on at least one speaker monitor signal; and adjusting the modifying by the excursion limiter of the input audio signal based on the second excursion prediction. In some embodiments, the first excursion prediction is a fixed-model excursion prediction; the second excursion prediction may be determined from a direct displacement estimate based on at least one speaker monitor signal; the direct displacement estimate may be based on a speaker voltage monitor signal; the direct displacement estimate may be based on a speaker current monitor signal and an excursion-limited audio signal output from the excursion limiter; the correction factor may be determined from a third excursion prediction based on the excursion-limited audio signal from the excursion limiter; and/or the correction factor may be based on a predetermined excursion limit value. This method and other methods and operations disclosed herein may be performed by analog and/or digital electronic circuitry. In some embodiments, the operations and algorithms described may be performed by a processor, such as a digital signal processor (DSP).

According to another embodiment, a method for overseeing excursion characterization for a speaker model of a speaker may include using a speaker model to create an excursion estimate for the speaker; based on an audio input signal and the speaker to which the speaker model is modeled, deriving another excursion estimate; and comparing the excursion estimate and the another excursion estimate; and upon detecting an error based on the comparison of the excursion estimate and the another excursion estimate, generating a correction factor that is used to provide a corrected excursion estimate for the speaker. In some embodiments, the excursion estimate is derived using an excursion prediction block; the another excursion estimate is derived using a direct displacement estimate block; the comparing includes using a ratio between the another excursion estimate and the excursion estimate to determine the correction factor; the comparing includes using a ratio between the another excursion estimate and a fixed value to determine the correction factor; the excursion estimate may be determined from the speaker model; a measured signal may be used to determine the excursion estimate from the speaker model; the method may be used for overseeing excursion characterization to protect a speaker; a protected version of an input audio signal is used to determine the excursion estimate from the speaker model; a measured signal is used to determine the excursion estimate from the speaker model; and/or the corrected excursion estimate is used to determine an excursion characteristic of the speaker instead of the excursion of the speaker being based on the speaker model while characteristics of the speaker model are still statically maintained.

According to a further embodiment, a mobile device, such as a mobile phone, may include a microspeaker; an audio amplifier coupled to the microspeaker and configured to drive the microspeaker from an excursion-limited audio signal and configured to generate at least one speaker monitor signal; and an audio controller configured to receive an input audio signal and determine the excursion-limited audio signal based on the input audio signal. The audio controller may perform steps including modifying an input audio signal by an excursion limiter based on a first excursion prediction to obtain an excursion-limited audio signal for reproduction at a transducer; determining a second excursion prediction based on the at least one speaker monitor signal; and adjusting the modifying by the excursion limiter of the input audio signal based on the second excursion prediction.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

Figure 1:
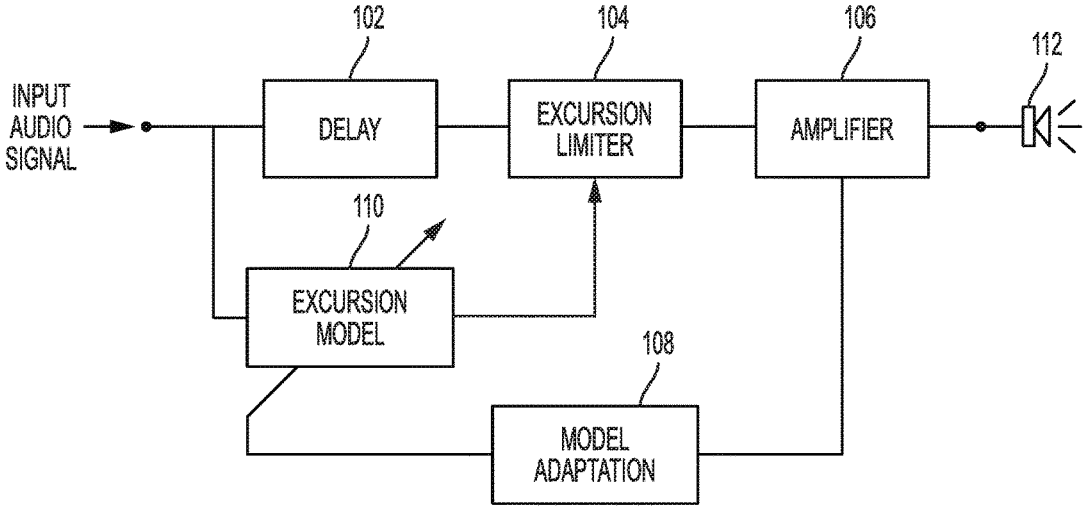
FIG. 1 PRIOR ART
FIG. 1 is a block diagram illustrating a conventional speaker protection system according to the prior art.
Figure 2:
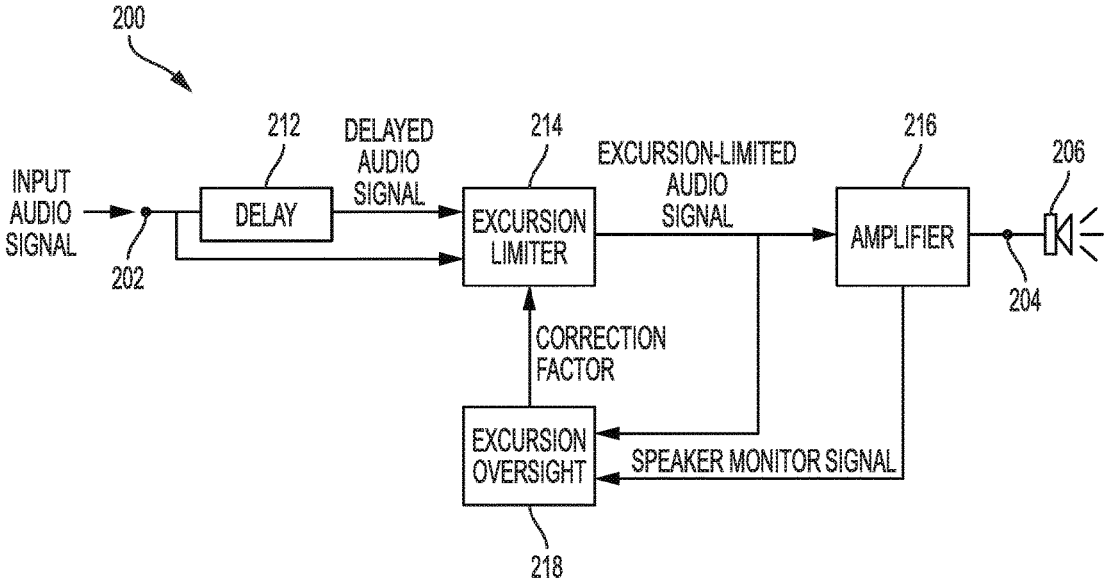
FIG. 2 is a block diagram illustrating an example speaker protection system according to some embodiments of the disclosure.

FIG. 2 is a block diagram illustrating an example speaker protection system according to some embodiments of the disclosure. In circuit 200, an input node 202 receives an input audio signal. The audio signal is delayed at delay block 212 to generate a delayed audio signal, which is input to excursion limiter 214. Excursion limiter 214 modifies the delayed audio signal to obtain a desired excursion for the speaker. For some signals, this may include attenuating the delayed audio signal to obtain an excursion-limited audio signal that reduces damage to the speaker. For other signals, this may include amplifying the delayed audio signal to obtain an excursion-limited audio signal that enhances loudness of the reproduced audio without damaging the speaker. Regardless of the modification performed by the excursion limiter 214, the excursion-limited audio signal is a modified audio signal intended to not over-extend the diaphragm of speaker 206. The excursion-limited audio signal is output to amplifier 216 to drive an output signal to output node 204 for speaker 206. This drives the speaker 206 to reproduce sounds without extending beyond desired excursion limits for the speaker 206. A speaker monitor signal may be determined by the amplifier 216 and output to excursion oversight logic 218. Example speaker monitor signals may include a voltage across and/or a current through the speaker 206. The oversight logic 218 may also receive the excursion-limited audio signal from excursion limiter 214. The excursion logic 218 may determine a correction factor to be applied by the excursion limiter 214 to change the levels of the excursion-limited audio signal.

The excursion limiter 214 may implement a first excursion prediction model, while the oversight logic 218 implements a second excursion prediction model. The first and second prediction models may be the same or different models and may be based on the same or different inputs. In some embodiments, the oversight logic 218 may include a model similar to that of the excursion limiter 214, but operate from different inputs. For example, the second model of the oversight logic 218 may be based on the speaker monitor signal, while the first model of the excursion limiter 214 is based on the input audio signal. In some embodiments, the oversight logic 218 may include a different model than that of the excursion limiter 214. For example, the oversight logic 218 may implement a direct displacement estimate, while the excursion limiter 214 may use a fixed or adaptive excursion model. The correction factor determined by the oversight logic 218 is shown input directly to the excursion limiter 214. In some embodiments, the correction factor may instead be used to modify a signal that is input to the excursion limiter.

Figure 3:
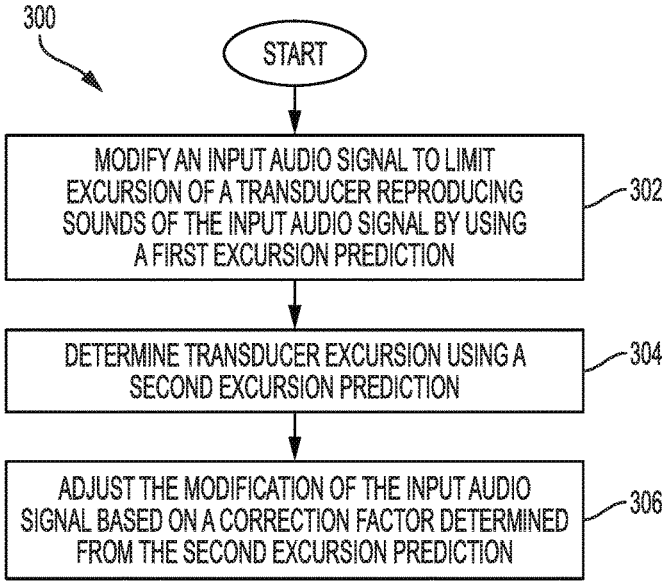
FIG. 3 is a flow chart illustrating an example method for adjusting a speaker signal using two excursion models according to some embodiments of the disclosure.

Operations of the speaker protection algorithm performed by the circuit of FIG. 2 are described in FIG. 3. Although FIG. 2 illustrates one embodiment for performing the functions of FIG. 3, other circuitry may be configured to perform similar functionality. FIG. 3 is a flow chart illustrating an example method for adjusting a speaker signal using two excursion models according to some embodiments of the disclosure. A method 300 begins at block 302 with modifying an input audio signal to limit excursion of a transducer when the transducer is reproducing sounds in the input audio signal. The modification of the input signal in block 302 may be performed by using a first excursion prediction. For example, this modification may be performed by the excursion limiter 214 of FIG. 2. The modification at step 302 may continue to be performed as the input audio signal is received. The modification may operate in real-time or near real-time, such as during the playback of a music file or reproduction of speech from a telephone call. Next, at block 304, a transducer excursion is determined using a second excursion prediction. For example, the second excursion prediction may be performed by excursion oversight logic 218 based on the speaker monitor signal and/or the excursion-limited audio signal. While the second excursion prediction is performed, the modification of the input audio signal at block 302 may continue. Next, at block 306, the modification performed at step 302 is adjusted based on the transducer excursion determined at block 304 from the second excursion prediction. For example, a correction factor determined by the oversight logic 218 of FIG. 2 may be applied to adjust the operation of the excursion limiter 214 or the first excursion prediction performed by the excursion limiter 214.

Figure 4:
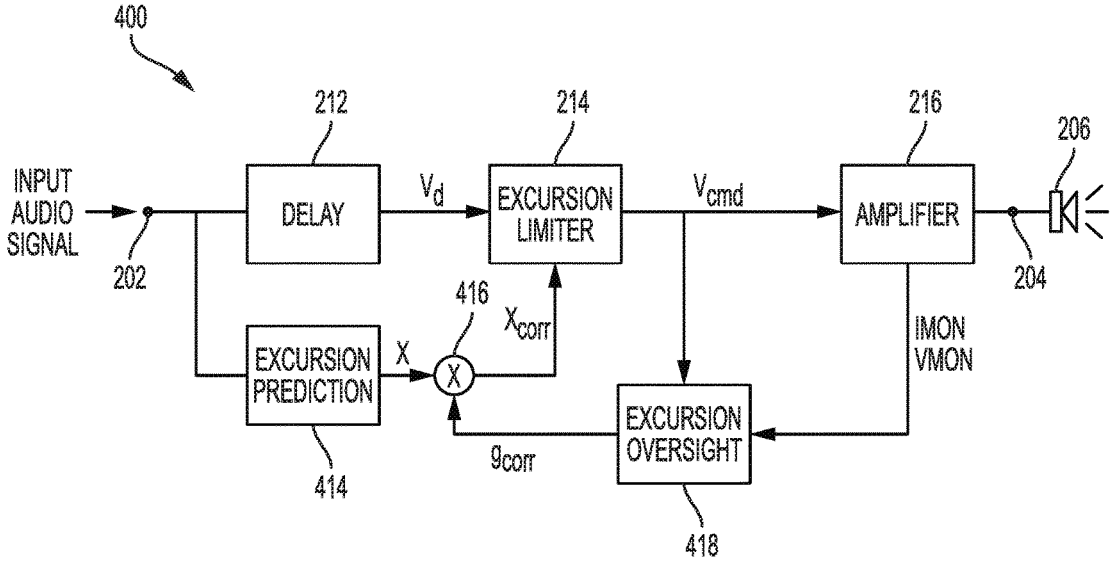
FIG. 4 is a block diagram illustrating an example speaker protection system for applying a correction factor to the output of the excursion prediction according to some embodiments of the disclosure.

As described above, the first excursion prediction based on the input audio signal may be performed within the excursion limiter and the correction factor applied to the excursion limiter. According to some embodiments, the first excursion prediction may be performed external to the excursion limiter and the correction factor applied to the excursion prediction before input to the excursion limiter. An example embodiment for this configuration is shown in FIG. 4. FIG. 4 is a block diagram illustrating an example speaker protection system for applying a correction factor to the output of the excursion prediction according to some embodiments of the disclosure. In circuit 400, excursion prediction 414 receives the input audio signal to generate a first excursion prediction X. Excursion oversight logic 418 determines a correction factor $g_{corr}$, which is used to adjust the first excursion prediction X at product block 416 to produce a corrected excursion prediction $X_{corr}$. The excursion limiter 214 receives a delayed audio signal $V_d$ and uses the corrected excursion prediction $X_{corr}$ to determine an excursion-limited audio signal $V_{cmd}$. The $V_{cmd}$ signal drives the amplifier 216 to reproduce sounds at speaker 206.

The oversight logic 418 oversees the accuracy of an excursion estimate generated by a speaker model of the excursion prediction 414. The oversight logic 418 may detect when the speaker's behavior is deviating from the excursion model, and subsequently force the excursion limiter 214 to apply more attenuation than otherwise provided for using the excursion model of excursion prediction 414. The oversight logic 418 may also detect when the excursion model is overly conservative with the attenuation, and subsequently force the excursion limiter 214 to amplify the audio signal $V_d$ to enhance loudness of the sounds. Some embodiments for detecting the speaker behavior deviation and determining an appropriate correction factor are described in FIG. 5 and FIG. 6.

Figure 5:
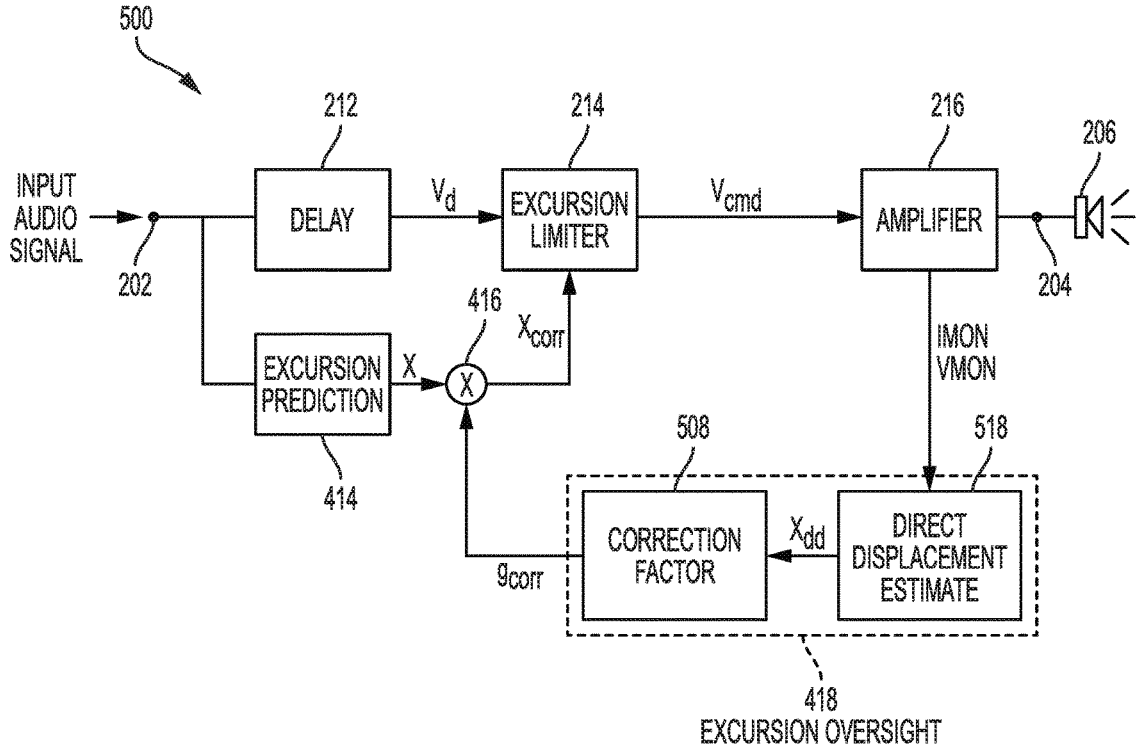
FIG. 5 is a block diagram illustrating an example speaker protection system using a direct displacement estimate according to some embodiments of the disclosure.

In FIG. 5, a circuit 500 is shown that uses a direct displacement estimate for determining the correction factor. FIG. 5 is a block diagram illustrating an example speaker protection system using a direct displacement estimate according to some embodiments of the disclosure. The oversight logic 418 includes a direct displacement estimation block 518 and a correction factor block 508. The direct displacement estimation block 518 receives feedback from the speaker 206, such as a voltage monitor signal and/or a current monitor signal. In some embodiments, the direct displacement estimation block 518 may receive the $V_{cmd}$ signal instead of the VMON signal. The direct displacement estimation block 518 determines an excursion estimate $X_{dd}$ used by the correction factor block 508 to determine the correction factor $g_{corr}$. The direct displacement estimate of block 418 operates as a second excursion prediction in the circuit 500. The correction factor block 608 may compare the estimate $X_{dd}$ to a predetermined excursion limit value to determine the correction factor $g_{corr}$. In other embodiments, the correction factor block 608 may compare the estimate $X_{dd}$ to a third excursion prediction as shown in FIG. 6.

Figure 6:
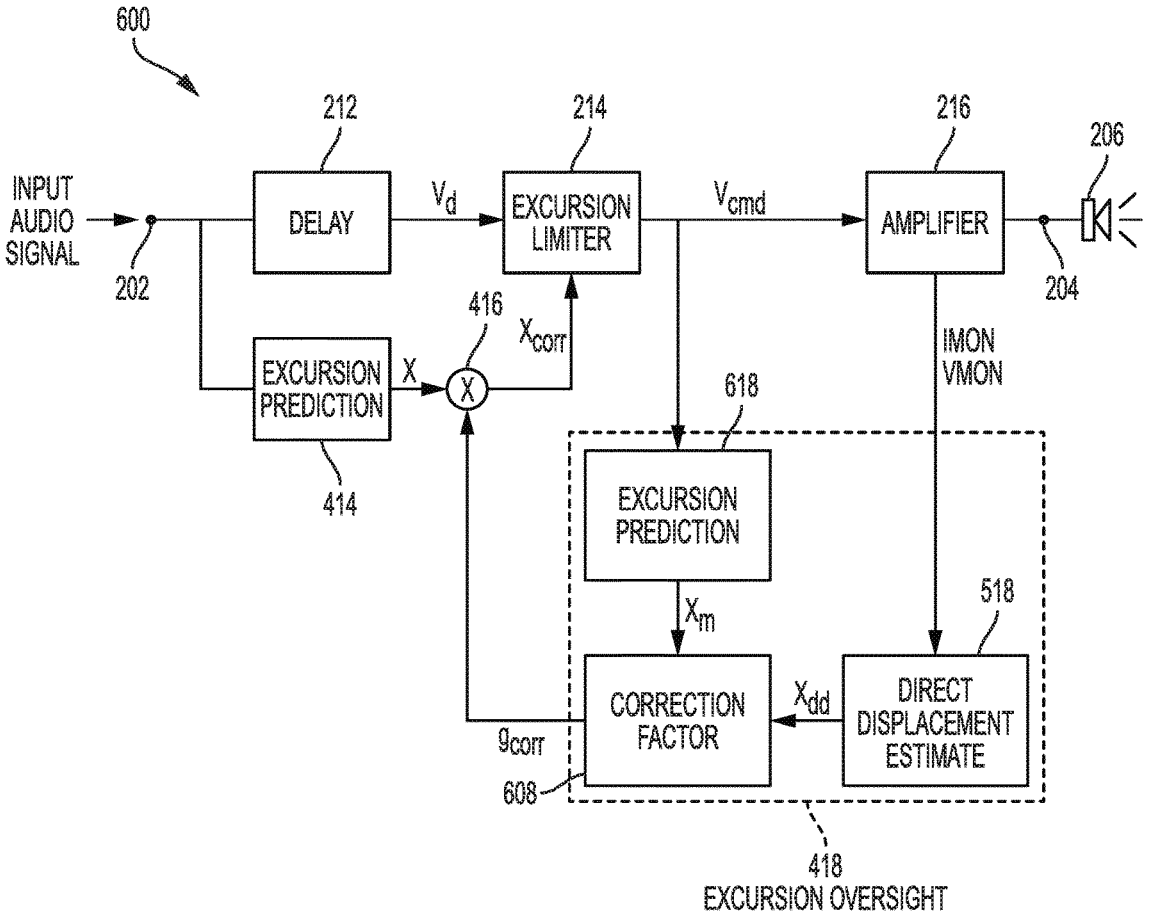
FIG. 6 is a block diagram illustrating an example speaker protection system using excursion oversight based on a second and third excursion prediction according to some embodiments of the disclosure.

FIG. 6 is a block diagram illustrating an example speaker protection system using excursion oversight based on a second and third excursion prediction according to some embodiments of the disclosure. Excursion oversight logic 418 includes direct displacement estimation block 518 as a second excursion prediction in circuit 600 and includes excursion prediction block 618 as a third excursion prediction in circuit 600. The excursion prediction block 618 may use the same model as used by the excursion prediction block 414. However, the third prediction of block 618 is based on the excursion-limited audio signal $V_{cmd}$, whereas the second prediction of block 414 is based on the input audio signal. The correction factor block 608 receives an excursion estimate $X_m$ from the excursion prediction block 618 and an excursion estimate $X_{dd}$ from direct displacement estimation block 518. These two predictions may be compared after being synchronized to account for delays between the signal $V_{cmd}$ and the input audio signal. A correction factor $g_{corr}$ may be determined from the comparison. In some embodiments, the correction factor block 618 may detect when peaks of the prediction $X_m$ are larger than the peaks of the prediction $X_{dd}$. The correction factor $g_{corr}$ is applied to the first excursion prediction X to form the corrected excursion prediction $X_{corr}$. As the corrected excursion prediction $X_{corr}$ is increased, the excursion limiter 214 provides more attenuation to the audio signal, which lowers the excursion to safe levels. Alternatively, the gain could be applied directly to the excursion threshold by reducing or increasing the excursion limit applied by the excursion limiter 214, which obtains an equivalent result to scaling the excursion.

Figure 7:
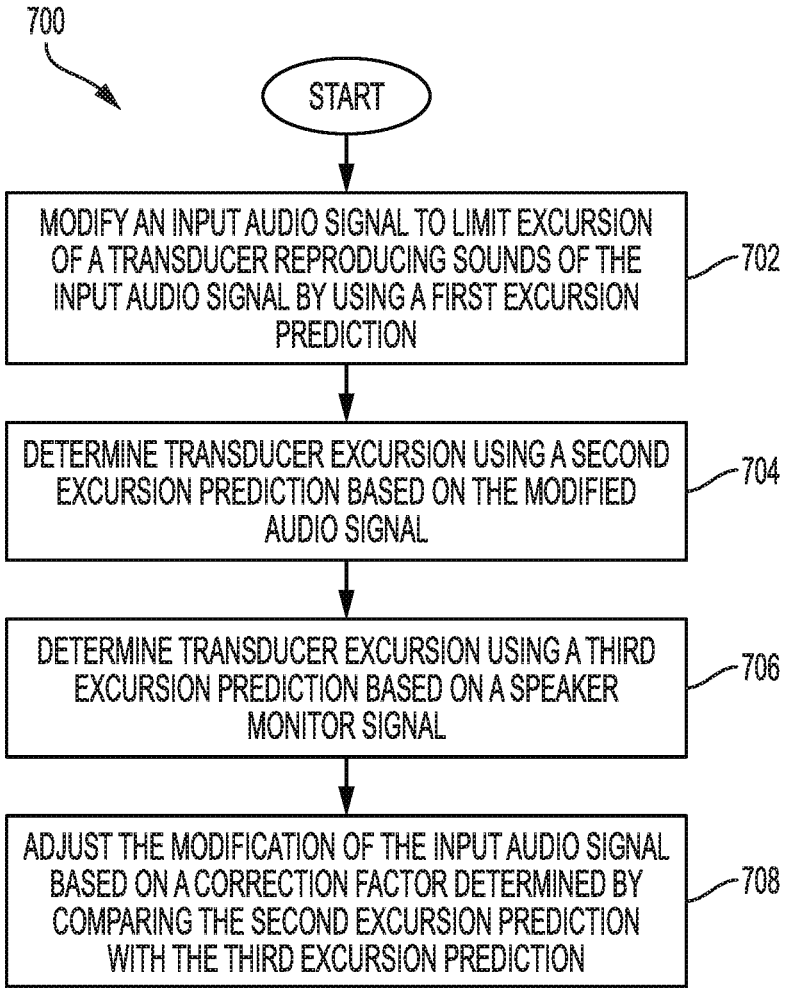
FIG. 7 is a flow chart illustrating an example method for speaker protection using a second and third excursion prediction according to some embodiments of the disclosure.

A method for speaker protection using three excursion models, such as in the embodiment of FIG. 6, is described generally with reference to FIG. 7. Although FIG. 6 illustrates one embodiment for performing the functions of FIG. 7, other circuitry may be configured to perform similar functionality. FIG. 7 is a flow chart illustrating an example method for speaker protection using a second and third excursion prediction according to some embodiments of the disclosure. A method 700 begins at block 702 with modifying an input audio signal to limit, by using a first excursion prediction, excursion of a transducer reproducing sounds from an input audio signal. At block 704, transducer excursion is determined using a second excursion prediction based on the modified, excursion-limited audio signal produced from step 702. At block 706, transducer excursion is determined using a third excursion prediction based on a speaker monitor signal. At block 708, the modification of the input audio signal at step 702 is adjusted to improve the speaker protection by using oversight based on the second and third excursion predictions. For example, the second and third excursion predictions may be compared and a correction factor determined based on the comparison.

Figure 8:
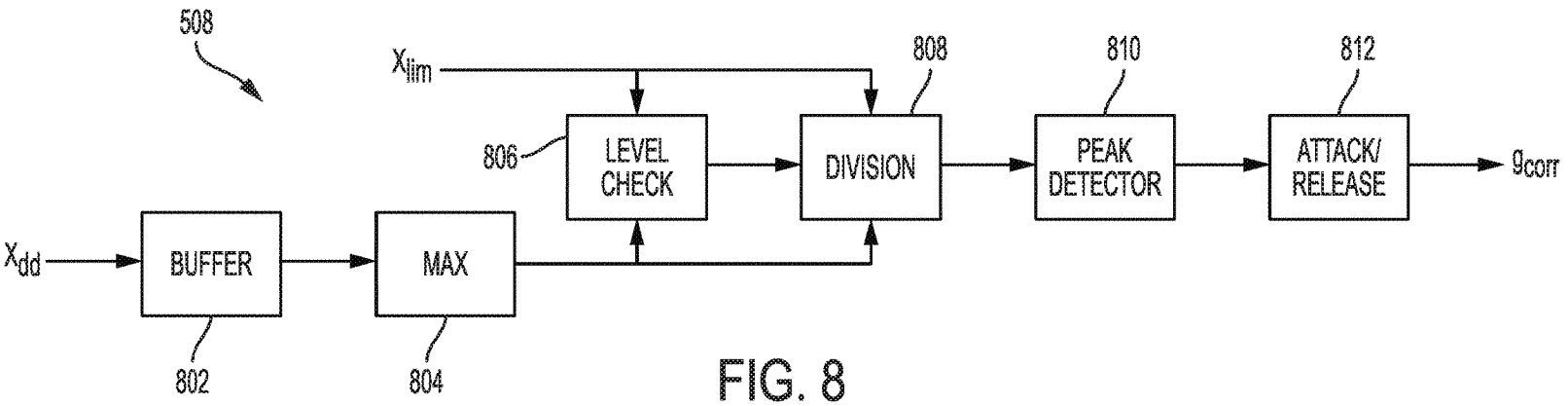
FIG. 8 is a block diagram illustrating an excursion oversight control using a predetermined excursion limit value according to some embodiments of the disclosure.
Figure 9:
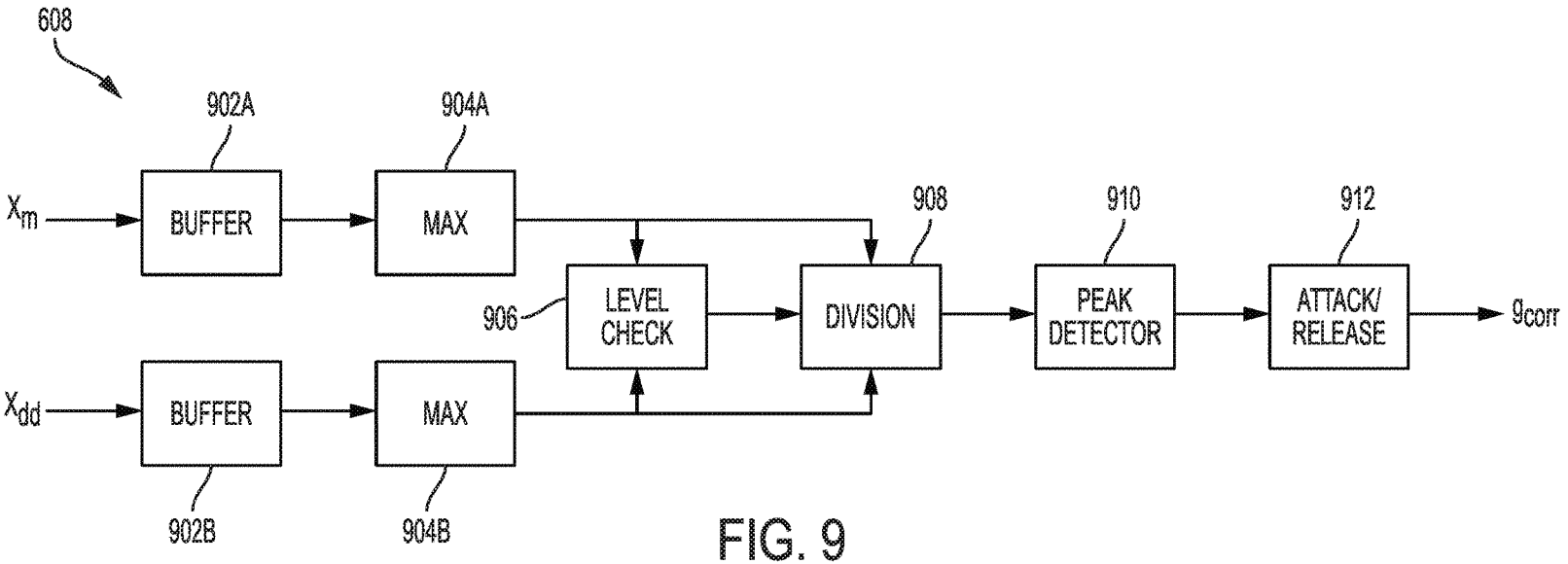
FIG. 9 is a block diagram illustrating an excursion oversight control using a second and third excursion prediction according to some embodiments of the disclosure.

Example circuits for calculation of the correction factor $g_{corr}$ in correction factor blocks 508 and 608 are shown in FIG. 8 and FIG. 9, respectively. FIG. 8 is a block diagram illustrating an excursion oversight control using a predetermined excursion limit value according to some embodiments of the disclosure. Correction factor block 508 may compare a direct-displacement excursion prediction $X_{dd}$ with a predetermined excursion limit value $X_{lim}$. The prediction $X_{dd}$ is first buffered in buffer 802 and a maximum of the buffered values determined at block 804. A level check 806 determines whether to enable division block 808 based on the values of $X_{dd}$ and $X_{lim}$. For example, level check 806 may disable division block 808 when $X_{dd}$ and $X_{lim}$ values are very small. When enabled, the division block 808 determines a ratio between the $X_{lim}$ and $X_{dd}$ predictions. In some embodiments, other mathematical values may be determined based on the $X_{lim}$ and $X_{dd}$ predictions. A peak detector 810 and attack/release block 812 operate on the determined ratio to compute the correction value $g_{corr}$. A similar determination may be used when there is a third excursion prediction as shown in FIG. 9.

FIG. 9 is a block diagram illustrating an excursion oversight control using a second and third excursion prediction according to some embodiments of the disclosure. The operation of correction factor block 608 is similar to that of correction factor block 508 of FIG. 8. A third excursion prediction $X_m$ is buffered into frames at block 902A, and the maximum value over the frames is determined at block 904A. A similar operation is performed on the second excursion prediction $X_{dd}$ with buffer 902B and maximum block 904B. Level check 906 determines whether the signals are above a given threshold to preserve accuracy. If both signals are above the threshold, they are divided at division block 908. This division yields the ratio of the third excursion prediction peaks to the second excursion prediction peaks. The ratio is then sent to a peak detector 910 and an attack/release block 912 to smooth the response. This correction factor $g_{corr}$ is then used to scale the first excursion prediction X that drives the excursion limiter.

In some embodiments, additional checks can be performed to verify that the feedback signals provide a suitable excursion estimate. For example, thresholds on Root Mean Square (RMS) levels of monitored signals VMON and IMON can be used to establish that VMON and IMON have sufficient content. Alternatively or additionally, checks on excursion levels or feedback signals can be used to form a confidence score on the direct displacement excursion prediction, which can drive the determination of the correction factor $g_{corr}$. For example, if confidence in the feedback signals is poor, the correction factor $g_{corr}$ can be forced to be only equal to or greater than 1. If direct displacement is determined to be reliable based on the signal levels, the oversight logic can be allowed to gain back some Sound Pressure Level (SPL) performance by reducing its estimated excursion by reducing the correction factor to less than one when possible.

The circuits and techniques for determining the correction factor $g_{corr}$ described above in FIG. 8 and FIG. 9 are only examples. Other methods for determining the correction factor may be used and may involve different determinations. For example, the correction factor may be based on a difference rather than a ratio of excursion values. In the circuits of FIG. 8 and FIG. 9, the division blocks 808 and 908 may be replaced with difference blocks. In this configuration, circuitry using the correction factor may sum the correction factor with the first excursion prediction for operating the excursion limiter. For example, product block 416 of FIG. 5 and FIG. 6 may be replaced with a summer block that combines the prediction X with the correction factor $g_{corr}$ to obtain a corrected prediction $X_{corr}$.

The direct displacement estimates described above are estimates of speaker excursion determined from feedback from the speaker, such as a current monitor signal IMON and/or a voltage monitor signal VMON. The direct displacement estimate may be based on the Thiele-Small model of a speaker. From this model, the following relationship is identified:

$$V_{in} = Re \cdot I + Le \cdot \frac{dI}{dt} + Bl \cdot \dot{x},$$

where Le is a model of coil inductance, Re is a model of coil resistance, Vin is the input voltage to the speaker from the amplifier, I is current into the speaker, and $\dot{x}$is speaker velocity. The displacement $X_{dd}$ can be determined from this equation as:

$$x_{dd} = \frac{1}{Bl}\int V_{in} - Re \cdot I - Le \cdot \frac{dI}{dt}\, dt$$

Figure 10:
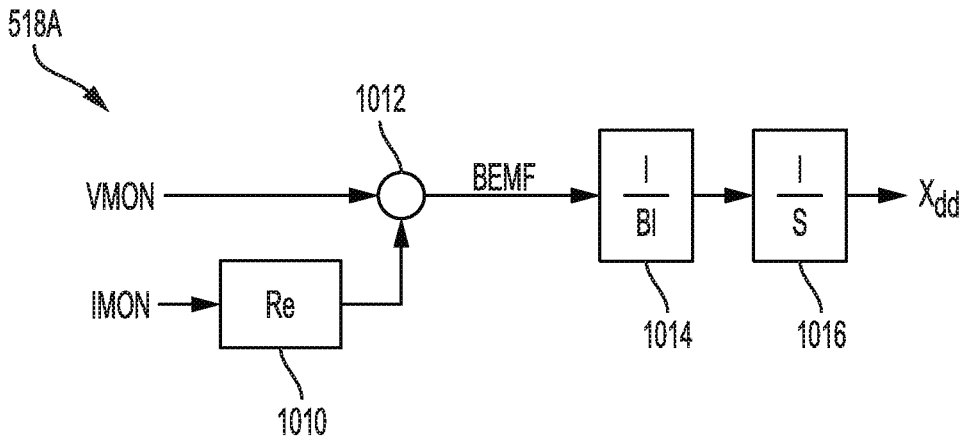
FIG. 10 is a block diagram illustrating a direct displacement estimate for excursion prediction according to some embodiments of the disclosure.
Figure 11:
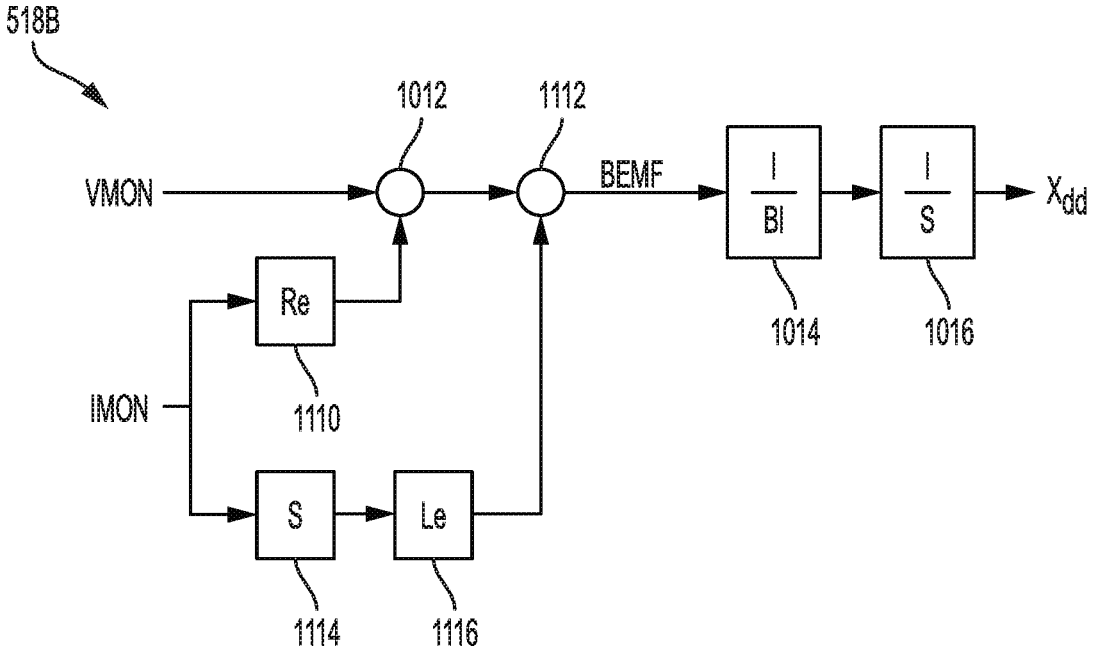
FIG. 11 is a block diagram illustrating another direct displacement estimate for excursion prediction according to some embodiments of the disclosure.

A circuit for determining a direct displacement estimate $X_{dd}$ is shown in FIG. 10. FIG. 10 is a block diagram illustrating a direct displacement estimate for excursion prediction according to some embodiments of the disclosure. The direct displacement estimate circuit 518A determines displacement when the inductance Le is neglected. This excursion estimate is formed by subtracting the resistive and inductive voltage drops at summer 1012 from Re block 1010, the voltage monitor signal, and the current monitor signal to derive the back electromotive force (backEMF) BEMF. The backEMF BEMF is integrated at block 1014 to obtain a speaker velocity, and integrated at block 1016 to obtain speaker position. When implemented in a digital system, derivatives and integrals computed as part of the determination may be approximated by Finite Impulse Response (FIR) or Infinite Impulse Response (IIR) filters. A similar, but full, estimate of direct displacement excursion, without neglecting inductance Le, is shown in FIG. 11. FIG. 11 is a block diagram illustrating another direct displacement estimate for excursion prediction according to some embodiments of the disclosure. Circuit 518B is similar to circuit 518A, with the inclusion of an inductance computation block 1116 computed using a derivative block 1114 of the current monitor signal IMON. The output of the inductance block 1116 is combined with the output of summer 1012 before input to integration block 1014.

The circuits of FIG. 10 and FIG. 11 are only example circuits for the computation of a direct displacement estimate. Other techniques can be used to improve the performance of direct displacement. In some embodiments, the monitored voltage signal VMON and monitored current signal IMON can be downsampled to reduce computation. In some embodiments, additional filtering can be applied to reduce noise or to limit the bandwidth of the signals to a particular range of frequencies to reduce computational resources required in determining the estimate.

The operations described above as performed by logic circuitry may be performed by any circuit configured to perform the described operations. Such a circuit may be an integrated circuit (IC) constructed on a semiconductor substrate and include logic circuitry, such as transistors configured as logic gates, and memory circuitry, such as transistors and capacitors configured as dynamic random access memory (DRAM), electronically programmable read-only memory (EPROM), or other memory devices. The logic circuitry may be configured through hard-wire connections or through programming by instructions contained in firmware. Further, the logic circuitry may be configured as a general-purpose processor (e.g., CPU or DSP) capable of executing instructions contained in software. Logic circuitry for operating on audio signals may be incorporated into an audio controller. The firmware and/or software may include instructions that cause the processing of signals described herein to be performed. The circuitry or software may be organized as blocks that are configured to perform specific functions. Alternatively, some circuitry or software may be organized as shared blocks that can perform several of the described operations. In some embodiments, the integrated circuit (IC) that is the controller may include other functionality. For example, the controller IC may include an audio coder/decoder (CODEC) along with circuitry for performing the functions described herein. Such an IC is one example of an audio controller. Other audio functionality may be additionally or alternatively integrated with the IC circuitry described herein to form an audio controller.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

The described methods are generally set forth in a logical flow of steps. As such, the described order and labeled steps of representative figures are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. For example, where general purpose processors are described as implementing certain processing steps, the general purpose processor may be a digital signal processors (DSPs), a graphics processing units (GPUs), a central processing units (CPUs), or other configurable logic circuitry. As another example, although processing of audio data is described, other data may be processed through the circuitry described above. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A method, comprising:

modifying an input audio signal by an excursion limiter based on a first excursion prediction to obtain an excursion-limited audio signal for reproduction at a transducer;

determining a second excursion prediction based on at least one speaker monitor signal;

determining a third excursion prediction based on the excursion-limited audio signal; and adjusting the modifying by the excursion limiter of the input audio signal based on the second excursion prediction, wherein the step of adjusting the modifying of the input audio signal comprises comparing the second excursion prediction and the third excursion prediction.

2. The method of claim 1, wherein the first excursion prediction is a fixed-model excursion prediction that does not adapt to changing characteristics of the transducer.

3. The method of claim 1, wherein the step of adjusting the modification comprises applying a correction factor to the first excursion prediction to correct the first excursion prediction.

4. The method of claim 1, further comprising applying a correction factor to the excursion limiter to adjust an excursion limit applied to the input audio signal.

5. The method of claim 1, wherein the step of determining the second excursion prediction comprises determining a direct displacement estimate based on at least one speaker monitor signal.

6. The method of claim 5, wherein the step of determining the second excursion prediction comprises determining a direct displacement estimate based on a speaker current monitor signal and based on a speaker voltage monitor signal.

7. The method of claim 5, wherein the step of determining the second excursion prediction comprises determining a direct displacement estimate based on a speaker current monitor signal and based on the excursion-limited audio signal.

8. The method of claim 1, wherein the step of adjusting the modifying of the input audio signal comprises comparing the second excursion prediction to a predetermined excursion limit value.

9. The method of claim 1, wherein the step of adjusting the modifying of the input audio signal comprises determining a correction factor to reduce speaker over-excursion.

10. The method of claim 1, wherein the step of adjusting the modifying of the input audio signal comprises determining a correction factor to amplify the input audio signal.

11. An apparatus, comprising:

an audio controller configured to perform steps comprising:

modifying an input audio signal by an excursion limiter based on a first excursion prediction to obtain an excursion-limited audio signal for reproduction at a transducer;

determining a second excursion prediction based on at least one speaker monitor signal;

determining a third excursion prediction based on the excursion-limited audio signal; and adjusting the modifying by the excursion limiter of the input audio signal based on the second excursion prediction, wherein the step of adjusting the modifying of the input audio signal comprises comparing the second excursion prediction and the third excursion prediction.

12. The apparatus of claim 11, wherein the first excursion prediction is a fixed-model excursion prediction that does not adapt to changing characteristics of the transducer.

13. The apparatus of claim 11, wherein the step of adjusting the modification comprises applying a correction factor to the first excursion prediction to correct the first excursion prediction.

14. The apparatus of claim 11, wherein the step of determining the second excursion prediction comprises determining a direct displacement estimate based on at least one speaker monitor signal.

15. The apparatus of claim 14, wherein the step of determining the second excursion prediction comprises determining a direct displacement estimate based on a speaker current monitor signal and based on a speaker voltage monitor signal.

16. The apparatus of claim 11, wherein the step of adjusting the modifying of the input audio signal comprises determining a correction factor to reduce speaker over-excursion.

17. A mobile device, comprising:

a microspeaker;

an audio amplifier coupled to the microspeaker and configured to drive the microspeaker from an excursion-limited audio signal and configured to generate at least one speaker monitor signal; and an audio controller configured to receive an input audio signal and determine the excursion-limited audio signal based on the input audio signal by performing steps comprising:

modifying an input audio signal by an excursion limiter based on a first excursion prediction to obtain an excursion-limited audio signal for reproduction at a transducer;

determining a second excursion prediction based on the at least one speaker monitor signal;

determining a third excursion prediction based on the excursion-limited audio signal; and adjusting the modifying by the excursion limiter of the input audio signal based on the second excursion prediction, wherein the step of adjusting the modifying of the input audio signal comprises comparing the second excursion prediction and the third excursion prediction.

18. The mobile device of claim 17, wherein the first excursion prediction is a fixed-model excursion prediction that does not adapt to changing characteristics of the transducer, and wherein the step of determining the second excursion prediction comprises determining a direct displacement estimate based on the at least one speaker monitor signal.

* * * * *